US007217176B2

(12) United States Patent
Schneider et al.

(10) Patent No.: US 7,217,176 B2
(45) Date of Patent: May 15, 2007

(54) POLISHING TOOL WITH SEVERAL PRESSURE ZONES

(75) Inventors: Gunter Schneider, Marburg (DE); Helwig Buchenauer, Dautphetal-Buchenau (DE); Ulf Börner, Marburg (DE); Klaus Krämer, Dautphetal-Friedensdorf (DE)

(73) Assignee: Schneider GmbH & Co. KG, Steffenberg (DE)

( * ) Notice: Subject to any disclaimer, the term of this patent is extended or adjusted under 35 U.S.C. 154(b) by 0 days.

(21) Appl. No.: 11/255,798

(22) Filed: Oct. 20, 2005

(65) Prior Publication Data

US 2006/0094341 A1 May 4, 2006

(30) Foreign Application Priority Data

Oct. 29, 2004 (DE) ..... 10 2004 052 945

(51) Int. Cl.
*B24B 5/00* (2006.01)

(52) U.S. Cl. ..... 451/283; 451/288; 451/398; 451/921

(58) Field of Classification Search ..... 451/42, 451/59, 158, 240, 255, 256, 277, 283, 285, 451/288, 317, 384, 398, 921
See application file for complete search history.

(56) References Cited

U.S. PATENT DOCUMENTS

| | | | | |
|---|---|---|---|---|
| 3,383,806 A | | 5/1968 | Stratemeyer | |
| 3,589,071 A | | 6/1971 | Hirschhorn | |
| 4,106,915 A | * | 8/1978 | Kagawa et al. | 51/296 |
| 5,175,961 A | | 1/1993 | Bolton | |
| 5,205,083 A | | 4/1993 | Pettibone | |
| 5,662,518 A | | 9/1997 | James et al. | |
| 5,695,393 A | * | 12/1997 | Granziera | 451/390 |
| 5,762,546 A | * | 6/1998 | James et al. | 451/504 |
| 5,928,063 A | * | 7/1999 | James et al. | 451/41 |
| 6,110,017 A | * | 8/2000 | Savoie et al. | 451/42 |
| 7,066,794 B2 | * | 6/2006 | Granziera et al. | 451/158 |
| 2002/0031993 A1 | * | 3/2002 | Jung et al. | 451/398 |
| 2003/0129925 A1 | * | 7/2003 | Toyoshima et al. | 451/5 |

FOREIGN PATENT DOCUMENTS

| | | |
|---|---|---|
| DE | 1 147 134 | 4/1963 |
| DE | 1 177 031 | 8/1964 |

(Continued)

*Primary Examiner*—Eileen P. Morgan
(74) *Attorney, Agent, or Firm*—Hudak, Shunk & Farine Co. LPA

(57) ABSTRACT

The invention refers to a polishing tool for optical lenses with at least one polishing pad adaptable at least partially to the shape of a lens surface of said lenses and drivable by means of a drive shaft, said polishing pad having a membrane, wherein said polishing pad can transmit a bearing force of said membrane at least in an orthogonal direction relative to a lens surface. Moreover, the polishing tool comprises a reinforcing member connectable to said membrane, said reinforcing member being dimensionally stable in a parallel direction relative to a surface of said membrane and being flexible and/or pliable in an orthogonal direction relative to the surface of said membrane, wherein at least one pressure pad with a pressure membrane is arranged within said polishing pad, wherein said pressure membrane can be made to bear and/or can be prestressed against said membrane or said reinforcing member in an indirect or in a direct manner.

25 Claims, 3 Drawing Sheets

FOREIGN PATENT DOCUMENTS

| | | |
|---|---|---|
| DE | 244 975 | 4/1987 |
| DE | 101 10 526 | 9/2001 |
| DE | 101 06 007 | 8/2002 |
| DE | 102 48 105 | 5/2003 |
| DE | 103 19 945 | 1/2005 |
| EP | 0 971 810 | 1/2000 |
| WO | 00/00324 | 1/2000 |
| WO | 03/059572 | 7/2003 |

* cited by examiner

POLISHING TOOL WITH SEVERAL PRESSURE ZONES

FIELD OF THE INVENTION

The invention refers to a polishing tool for optical lenses with at least one polishing pad adaptable at least partially to the shape of a lens surface of said lenses and drivable by means of a drive shaft, said polishing pad having a membrane, wherein said polishing pad can transmit a bearing force of said membrane at least in an orthogonal or normal direction relative to a lens surface, and having a reinforcing member connectable to said membrane, said reinforcing member being dimensionally stable in a parallel direction relative to a surface of said membrane and being flexible and/or pliable in an orthogonal or normal direction relative to the surface of said membrane.

BACKGROUND OF THE INVENTION

An apparatus is known from DE 103 19 945 A1 that shows a polishing tool for optical lenses with at least one polishing pad adaptable at least partially to the shape of a lens surface and driven by means of a drive shaft, wherein said polishing pad can transmit a bearing force at least in an orthogonal direction relative to the lens surface. According to the exemplary embodiment illustrated in FIG. 4, an armour member integrated into the polishing pad is provided between said polishing pad and said lens, wherein the polishing cover bears against said armour member. Said armour member is configured in such a manner that it is dimensionally stable in a parallel direction relative to the lens surface and flexible and/or pliable in an orthogonal direction relative to the lens surface.

WO 03/059572 shows a polishing tool for optical lenses with a polishing pad adaptable to the shape of a lens surface and driven by means of a drive shaft. In addition, a prestressing member is provided that is arranged above the polishing pad and presses or prestresses the polishing pad circumferentially against the polishing cover in selected places by means of several flexible pressure arms.

EP 0 971 810 B1 shows a lapping tool for eye correction lenses with a lapping membrane that is in active contact with a cylinder arrangement so that the membrane can bear against the surface to be treated and is movable relative to that surface, wherein the respective cylinder axle comprises a predetermined front geometry so that polishing material can be fed depending on the relative motion.

SUMMARY OF THE INVENTION

The object of the invention is to configure and arrange a tool for polishing lenses in such a manner that a consistent polishing process and a continuous adaptation of the tool are ensured.

The characteristic features of the independent claim achieve this object, thereby enabling the membrane of the polishing pad to be deformed deviating from a symmetrical or spherical shape by means of the internally arranged pressure pads and thus to be adapted optimally to the lens surface, wherein said pressure pad presses via its pressure membrane against the polishing pad membrane or rather the reinforcing member included in said polishing pad membrane and bulges them partially according to the shape and size of said pressure membrane. The pressure membrane is flexible so that it can bear against any surface, which means that the pressure membrane can assume any surface shape and evenly generate compression force regarding the surface formed like that.

For this purpose it is also advantageous that the pressure membrane, with respect to a surface that can be made to bear against the membrane or the reinforcing member, is formed to be smaller than a membrane surface adaptable to the lens surface by at least 20%. For the purpose of adapting to the lens surface and considering the radii of curvature existing in the lens, a relatively small pressure membrane ensures the formation of a curvature zone within the membrane. Within the curvature zone, the curvature of the membrane deviates from its basic curvature. If several pressure membranes are used, the surface proportion is smaller than that of the membrane by at least 50%. It is also provided to use a pressure membrane that, regarding the shape of its bearing surface, is adapted to the desired curvature zone.

For this purpose it is advantageous that the pressure membrane is circular, oval or bone-shaped with respect to the surface that can be made to bear against the membrane or the reinforcing member. The pressure membrane is shaped in such a manner that the desired bulge of the polishing pad or the reinforcing member is produced considering the lens surface bearing against it. Besides a circular or oval shape of the pressure membrane, said bone shape provides the possibility of generating an appropriate pressure on the membrane of the polishing pad by means of a pressure membrane preferably opposite the centre of the polishing pad in order to enable the polishing pad to bear against the lens surface within these two regions. Other shapes of the pressure membrane enabling the polishing pad or rather its membrane to bear against the lens surface are also provided, in particular such shapes that produce a desired geometric surface.

For this purpose it is also advantageous that at least three pressure pads are provided, wherein at least a first pressure pad, a second pressure pad, and a third pressure pad are arranged next to each other. If three pressure pads are used, a bulge of the polishing pad can be generated in the plane of the pressure pads, wherein the central pressure pad projects over its two adjacent pressure pads, while its two adjacent pressure pads ensure a gentle runout of the bulge formed like that. Moreover, the polishing pad is rotationally symmetrical and comprises an axis of symmetry S, wherein the first pressure pad is arranged concentrically of an axis of symmetry S and the second pressure pad and the third pressure pad are arranged diametrically, thereby enabling the complete lens surface to be treated. A zonal treatment of the lens surface including a superimposed path guidance of the polishing tool on the lens surface in addition to the polishing motion is not necessary. The complete surface of the polishing cover bears against the lens surface, wherein the polishing cover is pressed against the surface or adapted to it via the pressure pads and the reinforcing member, thereby enabling each point on the lens surface to be treated evenly and in the same way when the polishing motion (preferably a vibrational or eccentric motion) starts.

It is also advantageous that five or seven pressure pads are provided, wherein four or six pressure pads are arranged around the concentrically arranged first pressure pad. If five pressure pads are used, two different radii of curvature of the polishing pad can be generated starting from the centrical pressure pads as described above. Using additional pressure pads ensures the formation of bulge shapes of the polishing pad or the membrane that correspond to the existing geometrical configuration, in particular to the symmetry relations based on the centrically arranged pressure pad.

Finally it is advantageous that all additional pressure pads are arranged opposite the diametrically arranged pressure pads and distributed evenly. The even distribution of the pressure pads ensures a symmetrical configuration of the polishing pad bulge that can be generated like that.

It is also advantageous that a connecting flange for attaching the membrane and one connecting flange each for attaching the respective pressure membrane are provided. The pads made up of said connecting flange and said membrane/pressure membrane are attached by means of said connecting flange and supplied with compressed air. The respective membrane/pressure membrane comprises a preferably wave-shaped sidewall that can be connected to the respective connecting flange in a sealing-tight fashion.

It is particularly important for the present invention that the pressure pads can be pressurized with different internal pressures relative to each other and that the first connecting flange for the first pressure pad, the second and third connecting flanges for the second and third pressure pads, and the additional connecting flanges for the additional pressure pads are each connectable to equal or to different pressure levels. The different internal pressures or pressure levels ensure the formation of the desired, preferably acruate bulge of the polishing pad considering the desired contact zones between the polishing pad and the lens surface.

It is also advantageous that the reinforcing member is at least partially included in or integrated into the membrane or that the reinforcing member is arranged within the polishing pad and can be made to bear against the membrane from the inside. The reinforcing member serves to transmit the polishing motion in a parallel direction relative to the lens surface without any loss and is therefore connected to the membrane, wherein the integration into the membrane itself in the form of an armour member ensures a very firm and lossless connection between the two parts. Alternatively, the reinforcing member can bear against the membrane from the inside and be connected to the membrane by frictional connection and/or form closure preferably on the edge of the reinforcing member so that the polishing motion generated by the tool and transmitted via the membrane to the reinforcing member is generated parallel to the lens surface also in the centre of the polishing pad at a minimum of losses.

It is also advantageous that the reinforcing member is made of sheet metal, a plastic material and/or a fiber-reinforced plastic material. The use of sheet metal or a fiber-reinforced plastic material ensures the desired rigidity in a parallel direction relative to the lens surface considering a point of application of force where the reinforcing member is connected firmly and directly to the polishing tool or a drive axle.

According to a further development it is also possible to configure the reinforcing member in such a manner that it is flexible in an orthogonal or normal direction relative to the membrane or to the lens surface and comprises a thickness of between 0.1 mm and 5 mm, between 0.2 mm and 0.8 mm, in particular 0.3 mm, providing a flexible and universal adaptation of the reinforcing member to a wide variety of different lens surfaces. In spite of the strength or rigidity of the used materials such as sheet metal or fiber-reinforced plastic material, the reinforcing member can be adapted to the lens surface in the desired manner, i.e. substantially in a normal direction relative to the lens surface, because the reinforcing member is very thin. During the treatment process, the reinforcing member bears against the lens surface or is formed on it via the polishing cover so that the reinforcing member cannot buckle in spite of a very small wall thickness. Depending on the particular shape of the lens surface and the included radii or curvatures, the desired flexibility of the reinforcing member is ensured by adapting the thickness of the reinforcing member considering the used material, thus enabling the reinforcing member to bear against or be formed on lens surface shapes of lenses of different optical strengths or different radii of curvature in an even and universal manner.

In connection with the configuration and arrangement according to the present invention it is advantageous that the reinforcing member is deformable to assume a toric basic shape by means of the pressure pads. Said toric basic shape of the reinforcing member serves to adapt said reinforcing member to the particular lens surface to be treated even before it comes to bear against the lens, wherein this adaptation is carried out roughly or to the possible extent. The adaptation to the particular lens and its surface geometry is ensured by the pressure pad/s combined with the elasticity of the reinforcing member. The polishing process is a continuous process that requires a continuous or dynamic adaptation of the pressure pads, the reinforcing member and the membrane to the locally varying surface geometry of the relatively moved lens. It is also provided to adapt the curvatures of the polishing pad membrane that are generated by the pressure pads, wherein this adaptation is achieved by varying the pressure conditions in the pad/s during treatment.

Finally it is advantageous that the polishing pad, for being received in a driving chuck, comprises a holding flange with a cylindrical bearing surface, said holding flange serving to guide the membrane radially. The polishing pad is arranged within this cylindrical holding flange so that the polishing motion of the holding flange is transmitted via the outer wall of the polishing pad to the membrane and thus to the reinforcing member. For this purpose, the reinforcing member is connected to the membrane preferably on the edge of the membrane so that a part of the membrane provides a form closure connection between the holding flange or rather its cylindrical bearing surface and the reinforcing member.

For this purpose it is also advantageous that the bearing surface comprises an inside diameter $d_i$ that corresponds to an outside diameter $d_a$ of the membrane and a height $h_H$ that corresponds to a height $h_R$ of the membrane, thereby enabling the bearing surface to bear against the membrane in the aforementioned manner.

For this purpose it is also advantageous that the holding flange comprises several pressure medium connections for several pressure medium channels to each of which at least one connecting flange is connectable. Since different pressure pads are pressurized with the same pressure on account of the existing symmetry relations, it is advantageous to use pressure medium channels that are connectable to the respective connecting flanges via corresponding connecting bores, said use ensuring a symmetrical distribution of pressure.

In this connection it is advantageous that each pressure medium connection is connectable to at least one pressure medium control line arranged at the driving end and that the pressure medium control line is integrated at the driving end into the driving chuck for the holding flange and connectable via the driving chuck to the holding flange. When the tool is received, said tool can be immediately connected to the corresponding pressure medium control lines by being received in the driving chuck, wherein no further connecting activities are required. Since the driving chuck inevitably clamps the holding flange, this clamping force can be used as a force that serves to connect the pressure medium control lines arranged at the driving end to the pressure medium connections. Corresponding coupling members could be spring-biased, thereby preventing the holding bearings of the holding flange within the driving chuck from being overdetermined.

In the treatment process it is advantageous that the first pressure pad is pressurized with a higher or lower internal pressure than the other pressure pads prior to and/or during the treatment of the lens and that the second pressure pad and the third pressure pad are pressurized with a higher or lower internal pressure than the other pressure pads prior to and/or during the treatment of the lens, thereby ensuring an optimal adaptation of the polishing pad to the surface shape of the lens. Depending on the polishing motion of the polishing pad, in particular depending on the extent of the swivelling amplitude, the different pressure levels of the different pressure pads can be controlled even during treatment. In addition, the membrane can be adapted to a concave or convex lens surface on account of the relative pressures.

BRIEF DESCRIPTION OF THE DRAWINGS

Further advantages and details of the present invention are set forth in the patent claims and the description and illustrated in the figures in which:

DETAILED DESCRIPTION OF THE INVENTION

Figure 1:
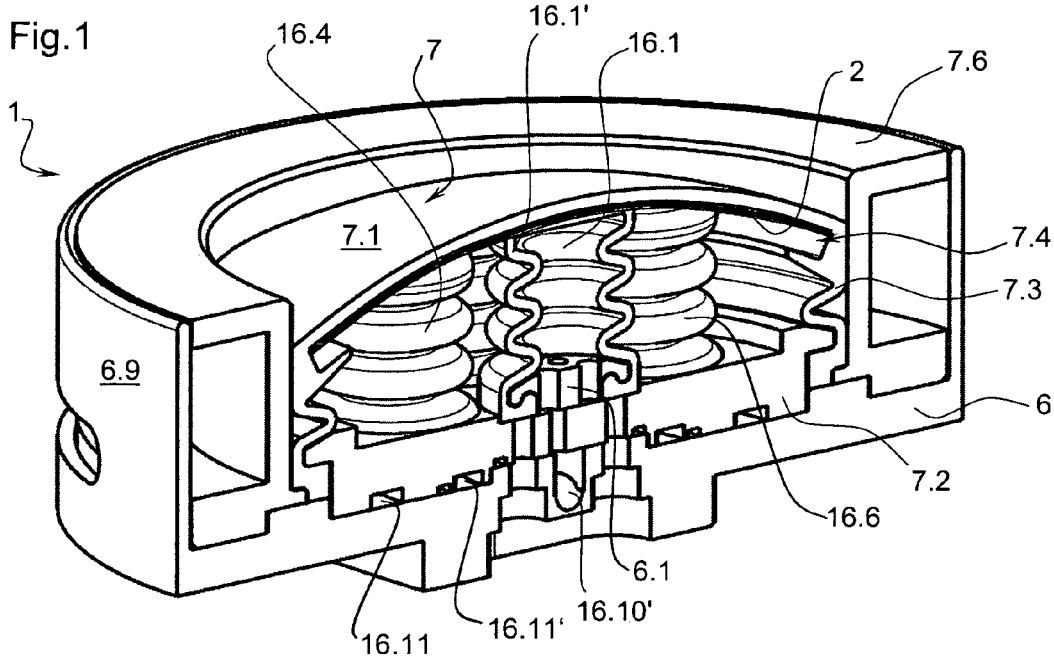
FIG. 1 is a perspective view of the polishing pad in a section A—A.

A polishing tool 1 illustrated in FIG. 1 comprises a holding flange 6 for a tool holding fixture (not shown) of a machine tool (not shown). The holding flange 6 comprises a cylindrical guide wall 6.9 formed as a jacket, wherein a polishing pad 7 is arranged within the holding flange 6 formed like that. The polishing pad 7 consists of a membrane 7.1 connected to the holding flange 6 via a connecting flange 7.2. The membrane 7.1 is dome-shaped and comprises a folded cylindrical edge 7.3 that connects it to the connecting flange 7.2.

Several pressure pads 16.1, 16.4, 16.6 that ensure a local bulging of the membrane 7.1 on account of their internal pressure are arranged within the polishing pad 7. The pressure pad 16.1 comprises a pressure membrane 16.1' that is connected to the connecting flange 7.2 by means of a connecting flange 6.1. Corresponding arrangements apply to the other pressure pads or pressure membranes 16.4, 16.6. The pressure pad 16.1 is supplied with compressed air via a partially shown pressure medium channel 6.10' of the holding flange 6. For supplying the other pressure pads 16.4, 16.6, the connecting flange 7.2 comprises two ring channels 6.11, 6.11' each forming a flow path connection (not shown) to the individual pressure pads 16.4, 16.6. According to FIG. 4, the ring channels 6.11, 6.11' can be supplied with pressure medium via additional pressure medium channels 6.10.

A reinforcing member 2 that is also dome-shaped is arranged between the individual pressure pads 16.1, 16.4, 16.6 and the membrane 7.1. On the edge 7.3, i.e. circumferentially, the reinforcing member 2 is arranged in a holding groove 7.4 of the membrane 7.1, said holding groove 7.4 being provided for this purpose. The polishing motion of the polishing tool 1 transmitted to the holding flange 6 via the tool holding fixture (not shown) is transmitted via the guide wall 6.9 to the edge 7.3 of the membrane 7.1 and from there to the reinforcing member 2. The reinforcing member 2 is connected to the membrane 7.1 by form closure on the edge 7.3 or in the holding groove 7.4 and by frictional connection by means of the various pressure pads 16.1, 16.4, 16.6.

An intermediate member 7.6 transmitting the polishing motion from the cylindrical guide wall 6.9 to the membrane 7.1 or rather to the edge 7.3 of the membrane 7.1 is provided between the cylindrical guide wall 6.9 and the membrane 7.1.

Figure 2:
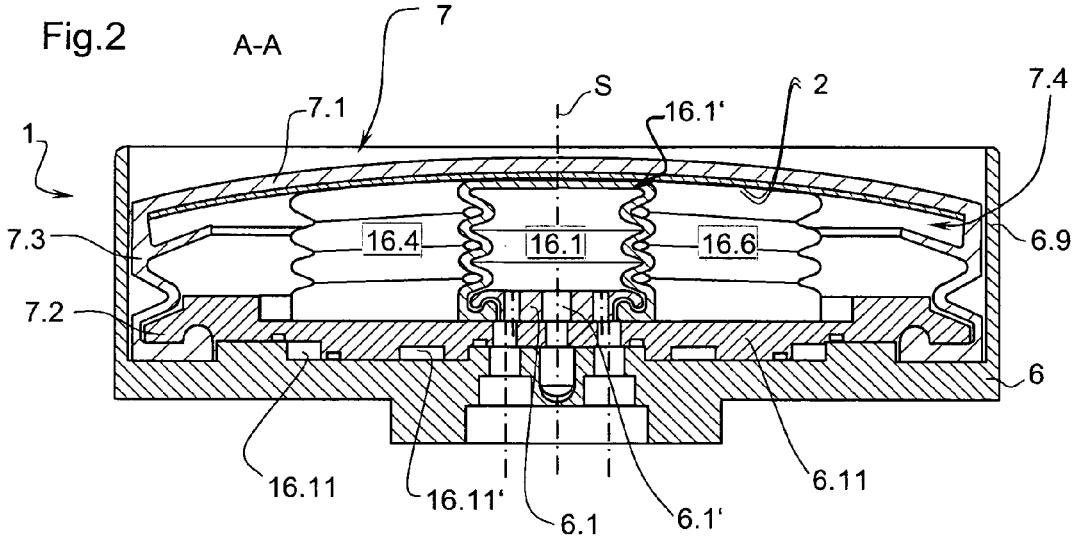
FIG. 2 is a sectional view A—A of the polishing pad.

The sectional view according to FIG. 2 shows an exemplary embodiment similar to that of FIG. 1. The right and left pressure pads 16.4, 16.6 are arranged symmetrically relative to an axis of symmetry S, wherein the central pressure pad 16.1 is arranged coaxially with the axis of symmetry S. The connecting flange 6.1 for the central pressure pad 16.1 comprises a pressure medium channel 6.1'. The pressure medium conducted via the holding flange 6 is conducted on to the central or first pressure pad 16.1 via said pressure medium channel 6.1'. The remaining connecting flanges 6.2 to 6.7 comprise corresponding pressure medium channels 6.2' to 6.7'. The edge 7.3 of the membrane 7.1 bears directly against the cylindrical jacket or cylindrical guide wall 6.9.

Figure 3:
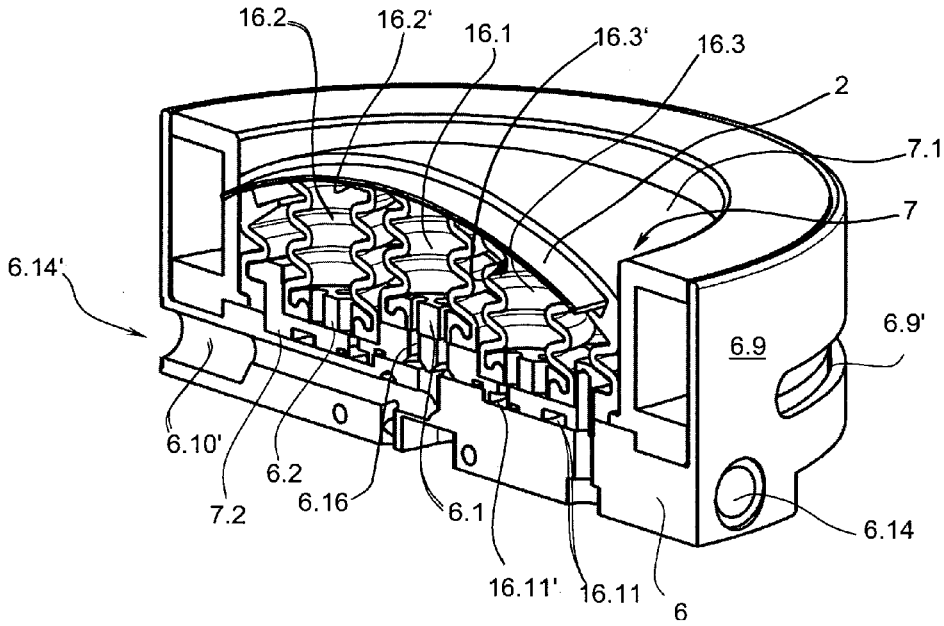
FIG. 3 is a perspective view of the polishing pad in a section B—B.

FIG. 3 shows a further perspective sectional view in a plane that lies vertically relative to the cutting plane according to FIG. 1. FIG. 3 shows a section of the first pressure pad 16.1 and of further pressure pads, i.e. of a second pressure pad 16.2 and a third pressure pad 16.3. The three pressure pads 16.1 to 16.3 are arranged one behind the other and diametrically to the membrane 7.1. The connecting flange 6.1 comprises a pressure medium connection 6.14' that leads into the pressure medium channel 6.10', wherein a flow path is provided between the pressure medium channel 6.10' and the respective connecting flange 6.1 to 6.3 for the first, second and third pressure pads 16.1 to 16.3 via corresponding connecting channels 6.16 to 6.16" of the connecting flange 7.2. The ring channels 6.11 or 6.11' for the remaining pressure pads are supplied with pressure medium via a further pressure medium connection 6.14 for the pressure medium channel 6.10 (not completely shown) according to FIG. 4. The cylindrical jacket or cylindrical guide wall 6.9 comprises several circumferentially arranged outlets 6.9' for polishing material that are offset in a circumferential direction.

Figure 4:
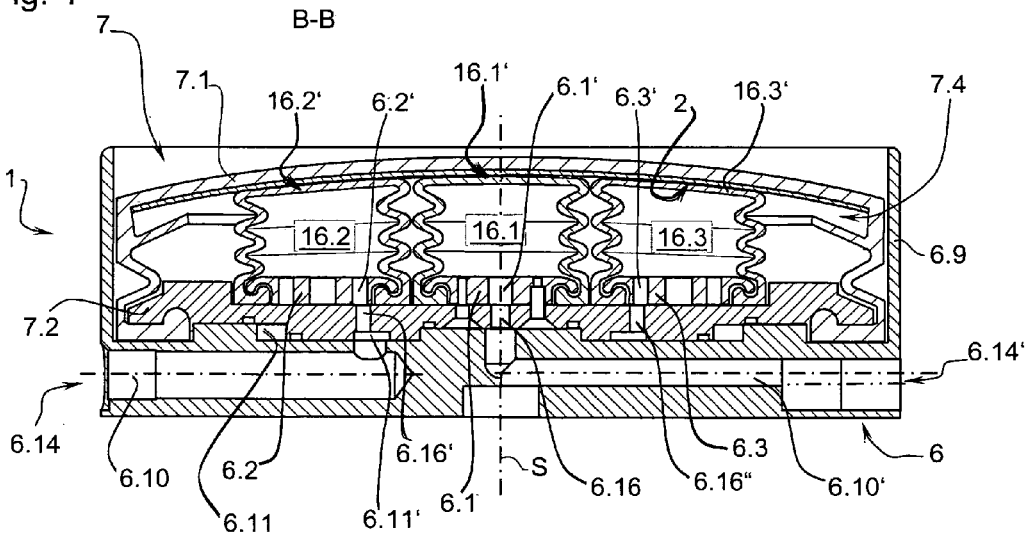
FIG. 4 is a sectional view B—B of the polishing pad.

FIG. 4 is a sectional view of an exemplary embodiment similar to the exemplary embodiment of FIG. 3. FIG. 4 shows the first pressure medium channel 6.10' for supplying the central pressure pad 16.1 and also shows the further pressure medium channel 6.10 with its pressure medium connection 6.14 that supplies the ring channel 6.11' and via the ring channel 6.11' the second pressure pad 16.2 and the third pressure pad 16.3 with pressure medium.

Figure 5:
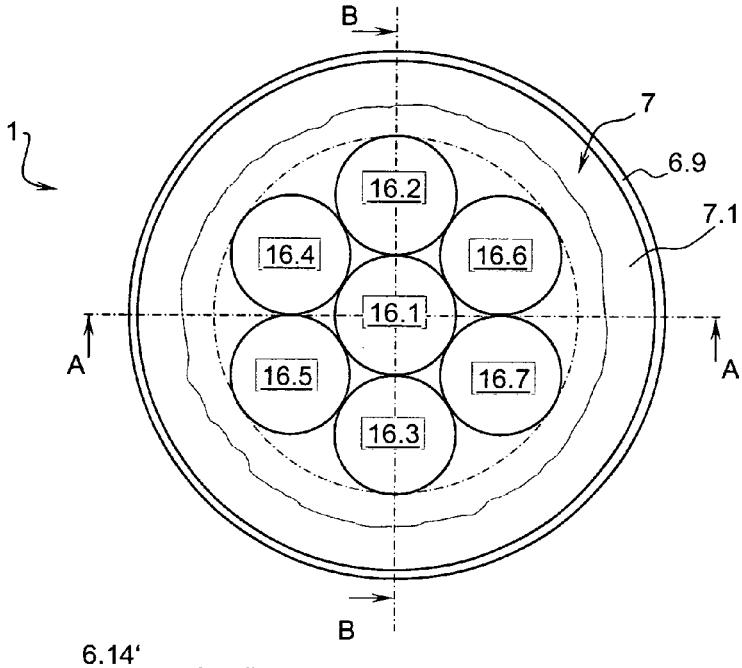
FIG. 5 is a view from above through the membrane.

FIG. 5 is a view from above. Seven pressure pads 16.1 to 16.7 are arranged within the cylindrical guide wall 6.9. The first pressure pad 16.1 is arranged coaxially with the cylindrical guide wall 6.9 and the membrane 7.1 arranged within the guide wall 6.9, while the second pressure pad 16.2 and the third pressure pad 16.3 are arranged diametrically thereto. The further pressure pads 16.4, 16.5 and the pressure pads 16.6, 16.7 are arranged in pairs opposite the first three pressure pads 16.1 to 16.3. An exemplary embodiment that is not shown here provides only five pressure pads 16.1 to 16.5, wherein three pressure pads are arranged diametrically a time so that the pressure pads 16.1 to 16.5 are aligned in a crosswise manner.

Figure 6A:
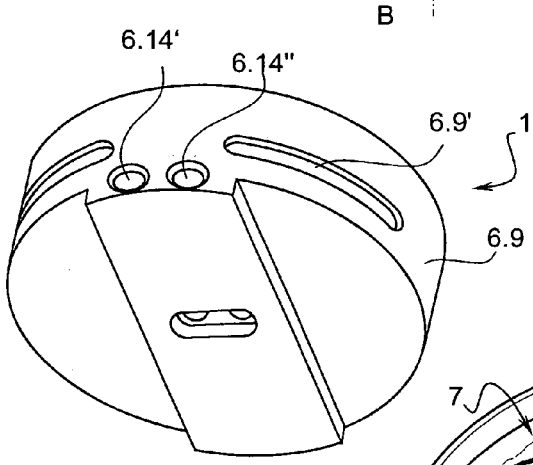
FIG. 6*a* is a perspective view of the polishing pad from below.

The perspective view according to FIG. 6*a* shows the holding flange 6 laterally from below. In addition to the pressure medium connection 6.14' for the central first pressure pad 16.1 there is provided a further pressure medium connection 6.14" that supplies the ring channel 6.11 according to FIG. 4 with pressure medium. In an exemplary embodiment that is not shown here, the pressure medium connections 6.14 to 6.14" are arranged in the region of a clamping surface (not completely shown here) of the holding flange 6 so that they are coupled directly on a compressed-air control line 1.3 of the clamping chuck when the holding flange 6 is fixed in the clamping chuck that is not shown here.

Figure 6B:
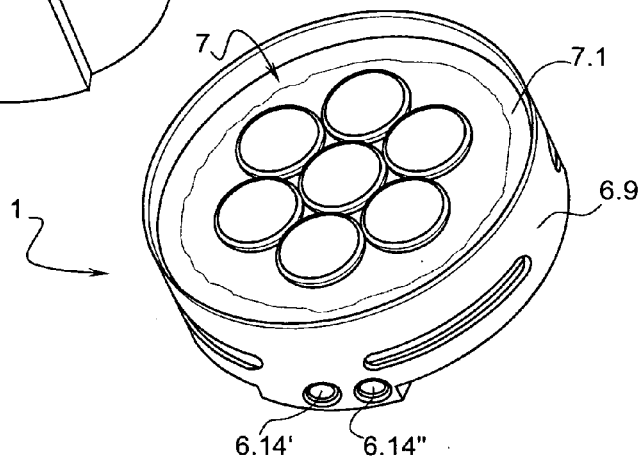
FIG. 6*b* is a perspective view of the polishing pad from above.

FIG. 6*b* is a perspective view laterally from above with the membrane 7.1 and the pressure pads 16.1 to 16.7 arranged therein.

LIST OF REFERENCE NUMERALS

1 polishing tool
1.1 housing part
1.2 housing part
1.3 compressed-air control line
1.4 housing adapter member
1.5 connecting screw
1.5' connecting screw
2 reinforcing member
2.1 recess
2.2 ring segment
2.3 coupling segment
2.4 slots
2.4' slots
2.4" slots
3 drive shaft
3.1 flange joint, screw
3.1' flange joint, screw
3.2 drive shaft bearing, deep groove ball bearing
4 eccentric shaft
4.1 sliding or rolling bearing, pair of deep groove ball bearings
4.2 inner race of bearing
4.3 outer race of bearing
4.4 clamping member
5.1 recess, feeding conduct
5.2 clamping screw, coupling member
5.3 recess
5.4 threaded connection
5.5 clamping nut
6 holding flange, connecting piece
6.1 connecting flange
6.1' pressure medium channel
6.2 connecting flange
6.2' pressure medium channel
6.3 connecting flange
6.3' pressure medium channel
6.4 connecting flange
6.4' pressure medium channel
6.5 connecting flange
6.5' pressure medium channel
6.6 connecting flange
6.6' pressure medium channel
6.7 connecting flange
6.7' pressure medium channel
6.8 holding clamp
6.9 jacket, cylindrical guide (wall)
6.9' outlet for polishing material
6.10 pressure medium channel
6.10' pressure medium channel
6.11 ring channel
6.11' ring channel
6.14 pressure medium connection
6.14' pressure medium connection
6.14" pressure medium connection
6.16 connecting channel
6.16' connecting channel
6.16" connecting channel
7 polishing pad, air pad
7.1 ring membrane, membrane
7.2 holding member, connecting flange
7.3 edge
7.4 holding groove
7.6 intermediate member
8 collar
9 polishing cover
10 lens
10.1 lens surface
11 coupling ring
11.1 circumferential groove
12 block piece
13 lining
13.1 recess
14 compressed-air control line
14.1 connection, arrangement of bearings
14.2 connection, arrangement of bearings
15 polishing-material conduit
16.1 pressure pad
16.1' pressure membrane
16.2 pressure pad
16.2' pressure membrane
16.3 pressure pad
16.3' pressure membrane
16.4 pressure pad
16.4' pressure membrane
16.5 pressure pad
16.5' pressure membrane
16.6 pressure pad
16.6' pressure membrane
16.7 pressure pad
16.7' pressure membrane
$d_a$ outside diameter
$d_i$ inside diameter
e eccentricity
E eccentric axis
$h_H$ height of jacket 6.9
$h_R$ height of ring membrane
M center line
Q cross-sectional shape
S axis of symmetry

What is claimed is:

1. A polishing tool for optical lenses comprising: at least one polishing pad adaptable at least partially to the shape of a lens surface of said lenses and drivable by means of a drive shaft, said polishing pad having a polishing pad membrane, wherein said polishing pad can transmit a bearing force of said polishing pad membrane at least in an orthogonal direction relative to a lens surface, and the polishing pad having a reinforcing member connected to said polishing pad membrane, said reinforcing member being dimensionally stable in a parallel direction relative to a surface of said polishing pad membrane and being flexible in an orthogonal direction relative to the surface of said polishing pad membrane, wherein at least one pressure pad with a flexible pressure membrane is arranged within said polishing pad, wherein said pressure membrane can be made to bear or can be prestressed against said polishing pad membrane or said reinforcing member.

2. The polishing tool according to claim 1, wherein a surface of the pressure membrane that can be made to bear against the polishing pad membrane or the reinforcing member, is formed to be smaller than a polishing pad membrane surface adaptable to the lens surface by at least 20%, wherein the reinforcing member is dome-shaped.

3. The polishing tool according to claim 1, wherein a surface of the pressure membrane that can be made to bear against the polishing pad membrane or the reinforcing member is circular, oval or bone-shaped.

4. The polishing tool according to claim 1, wherein at least three pressure pads are provided, wherein at least a first pressure pad, a second pressure pad, and a third pressure pad are arranged next to each other.

5. The polishing tool according to claim 4, wherein the polishing pad is rotationally symmetrical and comprises an axis of symmetry S, wherein the first pressure pad is arranged concentrically of the axis of symmetry S and the second pressure pad and the third pressure pad are arranged diametrically in relation to the axis of symmetry S.

6. The polishing tool according to claim 4, wherein five pressure pads are provided with four of the pressure pads concentrically arranged around the first pressure pad, or wherein seven pressure pads are provided with six of the pressure pads concentrically arranged around the first pressure pad.

7. The polishing tool according to claim 5, wherein all additional pressure pads are arranged opposite the diametrically arranged pressure pads and distributed evenly.

8. The polishing tool according to claim 1, wherein a connecting flange for attaching the polishing pad membrane and a connecting flange for attaching each of the at least one pressure membrane present are provided.

9. The polishing tool according to claim 5, wherein the pressure pads can be pressurized with different internal pressures relative to each other.

10. The polishing tool according to claim 4, wherein a first connecting flange is provided for the first pressure pad, a second connecting flange is provided for the second pressure pad, and a third connecting flange is provided for the third pressure pad, and wherein additional connecting flanges are present when additional pressure pads are present, and wherein the connecting flanges are connected to the respective pressure pads at equal or different pressure levels.

11. The polishing tool according to claim 1, wherein the reinforcing member is at least partially included in or integrated into the polishing pad membrane or wherein the reinforcing member is arranged within the polishing pad and can be made to bear against the polishing pad membrane from the inside.

12. The polishing tool according to claim 1, wherein the reinforcing member is made of sheet metal, a plastic material or a fiber-reinforced plastic material or a combination thereof.

13. The polishing tool according to claim 1, wherein the reinforcing member, in a normal direction relative to the membrane, has a thickness between 0.1 mm and 5 mm.

14. The polishing tool according to claim 1, wherein the reinforcing member is deformable to a toric shape by means of the pressure pads.

15. The polishing tool according to claim 1, wherein the polishing pad, adapted for being received in a driving chuck, comprises a holding flange with a cylindrical guide wall, said holding flange serving to guide the polishing pad membrane radially.

16. The polishing tool according to claim 15, wherein the guide wall comprises an inside diameter $d_i$ that corresponds to an outside diameter $d_a$ of the polishing pad membrane.

17. The polishing tool according to claim 15, wherein the guide wall comprises a height $h_H$ that corresponds to a height $h_R$ of the polishing pad membrane.

18. The polishing tool according to claim 15, wherein the holding flange comprises several pressure medium connections for several pressure medium channels wherein at least one connecting flange is connectable to each of the pressure member connections.

19. The polishing tool according to claim 18, wherein each pressure medium connection is connectable to at least one pressure medium control line arranged at a driving end of the pressure medium control line.

20. The polishing tool according to claim 19, wherein the driving end of the pressure medium control line is integrated into the driving chuck for the holding flange and is connected via the driving chuck to the holding flange.

21. A method for operating a polishing tool according to claim 4, including the step of pressurizing the first pressure pad with a higher or lower internal pressure than the other pressure pads prior to or during the treatment of the lens or both prior to and during the treatment.

22. A method for operating a polishing tool according to claim 4, including the steps of pressurizing the second pressure pad and the third pressure pad, independently, with a higher or lower internal pressure than the other pressure pads prior to or during the treatment of the lens both prior to or during the treatment.

23. A method for operating a polishing tool according to claim 13, wherein the reinforcing member has a thickness between 0.2 mm and 0.8 mm.

24. A method for operating a polishing tool according to claim 23, wherein the reinforcing member thickness is 0.3 mm.

25. A method for operating a polishing tool according to claim 3, wherein at least three pressure pads are provided, wherein at least a first pressure pad, a second pressure pad, and a third pressure pad are arranged next to each other.

* * * * *